United States Patent [19]

Winterhalter et al.

[11] Patent Number: 4,779,533

[45] Date of Patent: Oct. 25, 1988

[54] APPARATUS FOR SETTING THE IGNITION TIMING IN PROJECTILE FUSES

[75] Inventors: Walter Winterhalter, Tennenbronn; Wolfgang Schillinger, Schiltach, both of Fed. Rep. of Germany

[73] Assignee: Gebruder Junghans GmbH, Schramberg, Fed. Rep. of Germany

[21] Appl. No.: 118,024

[22] Filed: Nov. 6, 1987

[30] Foreign Application Priority Data

Nov. 15, 1986 [DE] Fed. Rep. of Germany ..... 3639201

[51] Int. Cl.[4] ..... F42C 17/00; F42C 9/04; F42C 15/04

[52] U.S. Cl. ..... 102/270; 89/6; 102/272

[58] Field of Search ..... 102/270, 271, 265, 266; 89/6

[56] References Cited

U.S. PATENT DOCUMENTS

| | | | |
|---|---|---|---|
| 1,511,622 | 10/1924 | Lucas | 89/6 |
| 2,446,745 | 8/1948 | Delay | 102/266 |
| 2,515,040 | 7/1950 | Hatcher | 102/270 |
| 2,849,956 | 9/1958 | Johnson et al. | 89/6 |
| 3,115,094 | 12/1963 | Simmen | 102/270 |
| 3,148,621 | 9/1964 | Varaud | 102/270 |
| 3,352,241 | 11/1967 | Combourieux | 102/271 |
| 3,715,986 | 2/1973 | Dunlap et al. | 102/276 |
| 3,824,889 | 7/1974 | Kaiser et al. | 89/6 |
| 3,877,378 | 4/1975 | Clark et al. | 102/270 |
| 4,389,937 | 6/1983 | Golay et al. | 102/249 |
| 4,594,944 | 6/1986 | Rongus et al. | 102/270 |

FOREIGN PATENT DOCUMENTS

| | | |
|---|---|---|
| 456603 | 11/1935 | United Kingdom . |
| 494200 | 10/1937 | United Kingdom . |

*Primary Examiner*—David H. Brown

*Attorney, Agent, or Firm*—Burns, Doane, Swecker & Mathis

[57] ABSTRACT

In a fuse for projectiles, a timing ring is mounted rotatably around the longitudinal axis of the fuse, whereby the ignition time or the ignition delay time may be set. To resist rotation of the set timing ring, the timing ring is secured by means of a friction system comprising a friction ring with a friction nut abutting against it. By screwing-down the friction nut, a frustoconical outer surface of the friction nut bears against a frustoconical inner surface of the friction ring to increase the resistance to rotation of the friction ring and thus the timing ring.

5 Claims, 2 Drawing Sheets

APPARATUS FOR SETTING THE IGNITION TIMING IN PROJECTILE FUSES

BACKGROUND OF THE INVENTION

The invention concerns a device for setting the ignition timing in projectile fuses. The device comprises a timing ring rotatable around the front-to-rear axis of the fuse for setting the ignition time.

From German Pat. No. 22 00 540, a device for setting the timing of a projectile fuse is known. The disclosure of that patent is incorporated herein by reference. The device consists of a stationary point, a rotatable part and a stationary lower part. The rotatable part comprises a timing ring and is used to get a predetermined ignition time or ignition delay. The timing ring may be rotated by a maximum of 360° and is equipped with a device whereby it is possible to set even longer time delays with a full rotation. To prevent the unintentional resetting of the set ignition time or delay time during subsequent manipulation of the fuse, special measures are usually effected by means of threaded bolts located on a circular ring.

A disadvantage of this arrangement involves the fact that, firstly, the assembly is relatively complex. Secondly, a nonuniform screwing-in of the bolts cannot be entirely prevented; the axial forces are fully applied to the individual threaded bolts and therefore deformations on the housing cannot be entirely avoided.

It is an object of the invention to provide a device of the afore-mentioned type, whereby the time setting torque customarily used in time fuses may be set exactly, and additionally a positive connection of the center and lower parts of the housing is possible.

SUMMARY OF THE INVENTION

These objects are achieved by the present invention which concerns a projectile fuse comprising a housing, ignition means, and time-setting means for setting a desired ignition time. The time-setting means comprises a timing ring rotatable about a front-to-rear longitudinal axis of the fuse. The timing ring is disposed at a generally central longitudinal location along the fuse. A friction ring is disposed within the timing ring. The friction ring includes a frustoconical inner surface. A friction nut is disposed within the friction ring and includes a frustoconical outer surface engaging the frustoconical inner surface. The friction nut includes a threaded inner surface threadedly received on a rear section of the housing such that screwing down of the nut increases the pressure of the outer surface against the inner surface to increase the resistance to rotation of the timing ring.

The invention provides the advantages that an improved long term behavior is achieved and that only a few structural parts are needed to create an effective frictional system, whereby the time setting torque customarily employed in time fuses may be set from 1 to 15 Nm. Simultaneously, with this type of a frictional system a positive connection of the timing ring (representing the center part of the housing) with the stationary lower part is obtained. The friction nut that may be screwed onto the stem of the stationary lower part of the housing is readily manipulated and may be turned in a simple manner to achieve a predetermined setting torque, while abutting against the friction ring.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
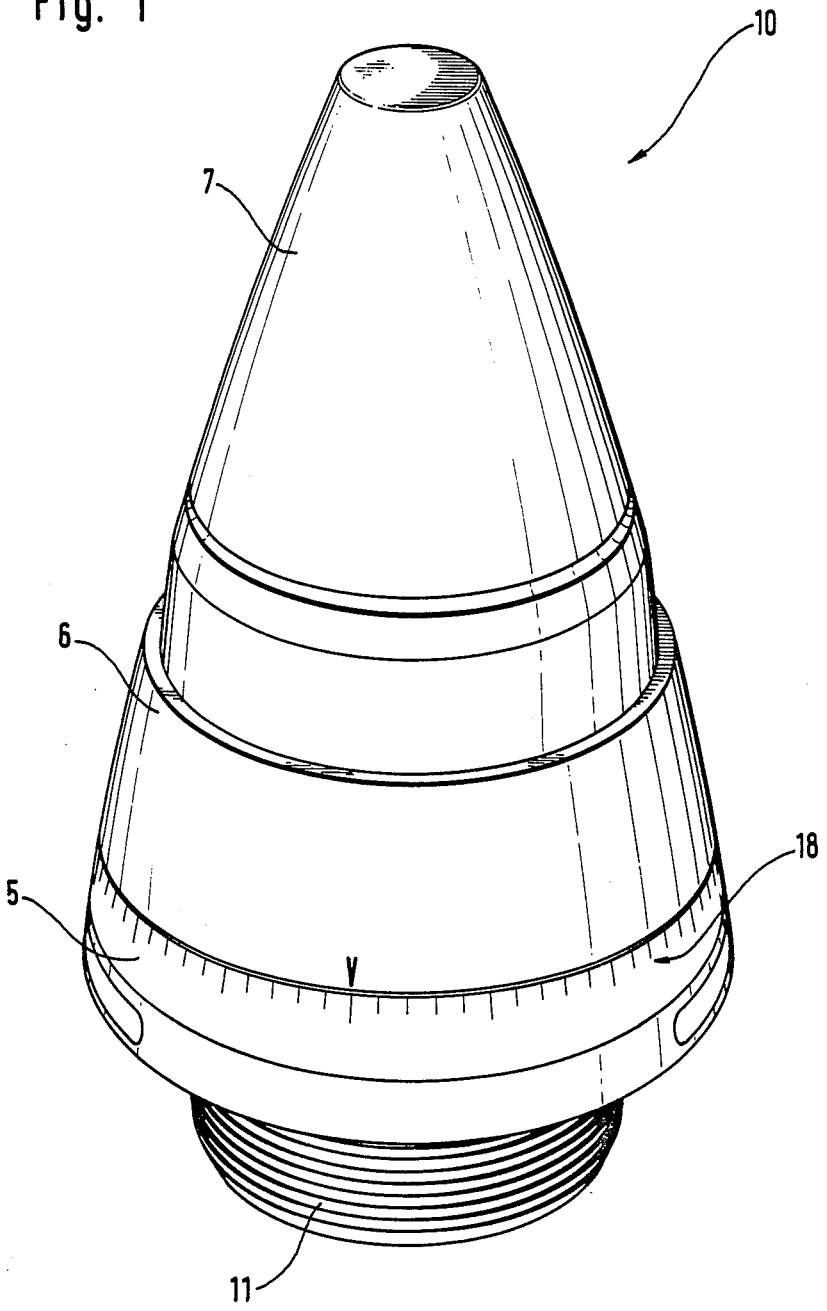
FIG. 1 depicts a perspective view of a projectile time fuse according to the invention.
Figure 2:
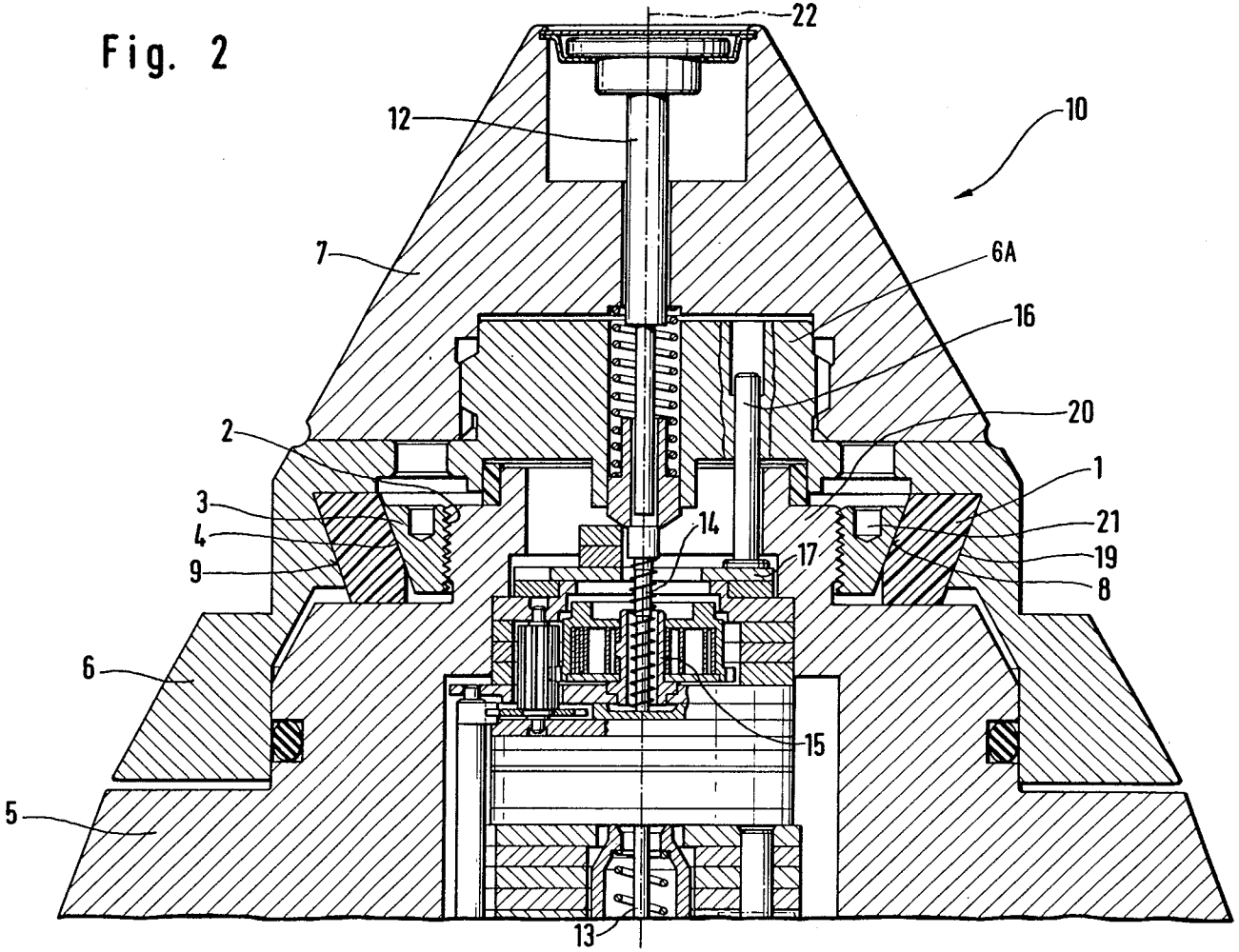
FIG. 2 is a longitudinal sectional view through the projectile time fuse according to FIG. 1.

A projectile time fuse 10 has at its rear end a threaded extension for fastening to a projectile. The fuse 10 comprises a screwed-on front point 7, a rotatable center housing part in the form of a timing ring 6, and a stationary rear housing part 5. The fuse timing is set by rotating the timing ring 6 which indicates that a predetermined delay time or ignition time has been set.

The turning of the timing ring 6 sets the delay or ignition time in a conventional manner. For this purpose, the timing ring 6 may be rotated by a maximum of 360°. By a full rotation a corresponding time may be set in seconds. In order to be able to set longer ignition times with a full rotation, the fuse may contain special devices, such as setting bolts (not shown), so that a longer time range may be obtained. The data shown on the scale 18 of the lower housing part 5 indicate the ignition or delay time in seconds.

In accordance with the present invention, the lower housing part 5 has an axially forwardly projecting center stem 20 which is externally threaded. Mounted on the stem 20 is a friction system comprising a friction nut 3 which is threaded onto the stem 20. The friction nut 3 is provided with a frustoconical outer circumferential surface 4 the diameter of which expands in the direction of the point 7 of the fuse. The friction nut 3 is disposed within the timing ring 6 and is spaced radially inwardly therefrom to form a space therebetween. In that space is disposed a friction ring 1 which is preferably formed of an elastically resilient material and includes a conical inner surface 8 inclined in the same direction as the circumferential surface 4 of the friction nut 3. The friction ring has a correspondingly frustoconical outer surface 9 which engages a frustoconical inner surface 9 of the timing ring 6. The friction ring 1 may comprise a split ring.

The timing ring 6 is installed by first inserting therein the ring 1 and nut 3. The nut 3 is then placed upon the stem 20 in such manner that a driving pin 16 connected to a conventional timing disk 17 enters a hole in a forward portion 6A of the timing ring 6. Then, the nut 3 is screwed down to apply a turning resistance to the timing ring 6. The friction nut 3 is screwed-down preferably by means of a tool which engages pockets 21 of the friction nut in order to turn it. The pockets 21 are machined into a friction nut 3 axially from its surface.

Rotation is continued until a predetermined amount of torque is required to turn the timing ring, usually a torque of from 1 to 15 Nm. There is thus achieved a positive connection of the ring 6 to the housing part 5. The friction nut 3 can then be affixed by the application of an adhesive thereto. Subsequently, the point 7 is screwed onto a forwardly projecting part 6A of the timing ring 6. The timing can then be set by rotating the ring 6.

Inside the fuse, along a longitudinal fuse axle 22 a front transfer ram 12 and a rear transfer ram 14 are coaxially arranged. The rear transfer ram 14 is coaxially aligned with a firing pin 13. In case of an axial impact, the firing pin 13 is pushed in a known manner into a detonator (not shown). The transfer ram 14 is located in a bushing 15. This arrangement, together with the timing disk 17, is conventional and disclosed in which is incorporated by reference herein.

The surfaces 4, 8, 9, 19 are mutually parallel and each forms an acute angle with the axis 22 no greater than 30°.

Although the present invention has been described in connection with a preferred embodiment thereof, it will be appreciated by those skilled in the art that modifications, substitutions, additions and deletions not specifically described may be made without departing from the spirit and scope of the invention as defined in the appended claims.

What we claim is:

1. In a projectile fuse comprising a housing, ignition means, and time-setting means for setting a desired ignition time, said time-setting means comprising a timing ring rotatable about a front-to-rear longitudinal axis of the fuse, the improvement wherein said timing ring is disposed at a generally central longitudinal location along said fuse, a friction ring being disposed within said timing ring, said friction ring including a frustoconical inner surface, a friction nut disposed within said friction ring and including a frustoconical outer surface engaging said inner surface, said friction nut including a threaded inner surface threadedly received on a rear section of said housing such that screwing-down of said nut increases the pressure of said outer surface against said inner surface to thereby increase the resistance to rotation of said timing ring.

2. Apparatus according to claim 1, wherein said friction nut includes forwardly facing recesses for receiving a turning tool.

3. Apparatus according to claim 1, wherein said outer surface of said friction nut and said inner surface of said friction ring each define an angle with said longitudinal axis no greater than 30 degrees.

4. Apparatus according to claim 1, wherein said timing ring includes a frustoconical inner surface and said friction ring includes a frustoconical outer surface engaging said inner surface of said timing ring.

5. Apparatus according to claim 4, wherein said outer surfaces of said friction nut and said friction ring, and said inner surfaces of said friction ring and said timing ring are all mutually parallel, the diameters thereof expanding in a forward direction.

* * * * *